United States Patent [19]

Papadakis

[11] 4,131,150

[45] Dec. 26, 1978

[54] ZIPPER-TYPE WINDOW FOR HOMES

[76] Inventor: Edythe A. Papadakis, 1323 Willow Rd., Baltimore, Md. 21222

[21] Appl. No.: 797,077

[22] Filed: May 16, 1977

[51] Int. Cl.[2] ..... E06B 3/30

[52] U.S. Cl. ..... 160/368 R

[58] Field of Search ..... 160/354, 368 R, 369, 160/371, 380, DIG. 18; 52/202, 206

[56] References Cited

U.S. PATENT DOCUMENTS

| | | | |
|---|---|---|---|
| 2,223,477 | 12/1940 | Bernier | 160/DIG. 18 |
| 2,391,871 | 1/1946 | Benson | 160/DIG. 18 |
| 2,859,493 | 11/1958 | Matschke | 52/202 |
| 3,729,045 | 4/1973 | MacDonald | 160/380 |

FOREIGN PATENT DOCUMENTS

| | | | |
|---|---|---|---|
| 1038731 | 9/1958 | Fed. Rep. of Germany | 160/DIG. 18 |

*Primary Examiner*—Peter M. Caun

*Attorney, Agent, or Firm*—Walter G. Finch

[57] ABSTRACT

The invention is an improved insulating or storm window application for windows of homes. The zipper-type window of this invention provides an easy and quick method of installation or removal of the insulating portion and, in addition, provides the beholder an attractive and decorative enclosure when viewed from the interior of the house. The insulating portion may be removed during portions of the year and the decorative interior aspect is not altered. The zipper-type window of this invention is insulation for both summer and winter conditions.

3 Claims, 3 Drawing Figures

ZIPPER-TYPE WINDOW FOR HOMES

BACKGROUND AND SUMMARY OF THE INVENTION

The invention relates to insulating and storm window application for windows of homes. In particular, it relates to the interior application of such insulating means.

A need has existed for a long time for an interior type insulating system for windows which, in addition to providing the insulation characteristics, was both easy and convenient to install or remove numerous times during the year, and at the same time was pleasing and attractive to the eye of the beholder. The present and continuing energy crisis has further pointed up the need for better insulating means. This invention provides such an interior type insulating system.

In the prior art many attempts have been made at providing interior means of insulating windows in homes. All have been either cumbersome to install, difficult to maintain or ugly in appearance.

The present invention overcomes all of the above mentioned characteristics, providing an insulating means that is easy to install as a total unit, easy and convenient to install and remove the insulating cover portion over the window for open-window use, simple to maintain, and by a novel and unique enclosure method provides an attractive decorative finish that is pleasing to the eye of the beholder.

None of the prior art teach the all-inclusive characteristics of the present invention, in which all of the sources of leakage are completely sealed, the basic or initial installation is simple, and the subsequent installation and removal of the insulating "pane" portion for open-window conditions is both simple and easy. In addition, none of the prior art teachings provide for a novel and unique method of enclosing the insulating system mechanism to provide an attractive and decorative appearance to the interior of the house as viewed by the eye of the beholder, as does the present invention.

It is therefore an object of the invention to provide a complete interior insulating means for the complete window assembly of a house.

It is another object of the invention to provide an insulating means for a complete window assembly that is reasonably easy to install initially at first application.

It is a further object of the invention to provide an insulating means for a complete window assembly that is economical to construct and install.

It is yet another object of the invention to provide an insulating means for a complete window assembly that may have the insulating cover portion removed for open-window use.

It is still another object of the invention to provide a complete window assembly that is simple, easy, and economical to maintain.

It is also a further object of the invention to provide an insulating means for a complete window assembly that is attractive and decorative to the eye of the beholder on the interior of the house.

Further objects and advantages of the invention will become more apparent in light of the following description of the preferred embodiments.

DESCRIPTION OF THE PREFERRED EMBODIMENTS

Figure 1:
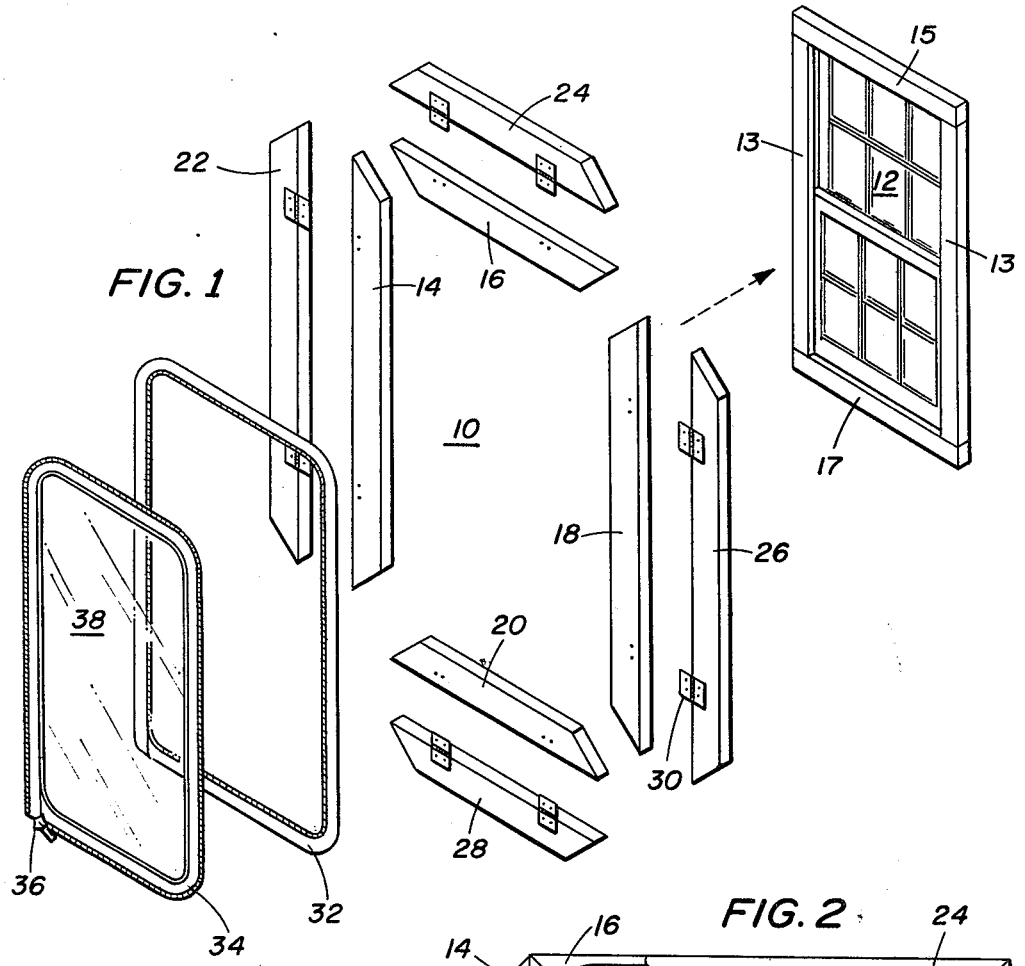
FIG. 1 is an exploded view showing all components.
Figure 2:
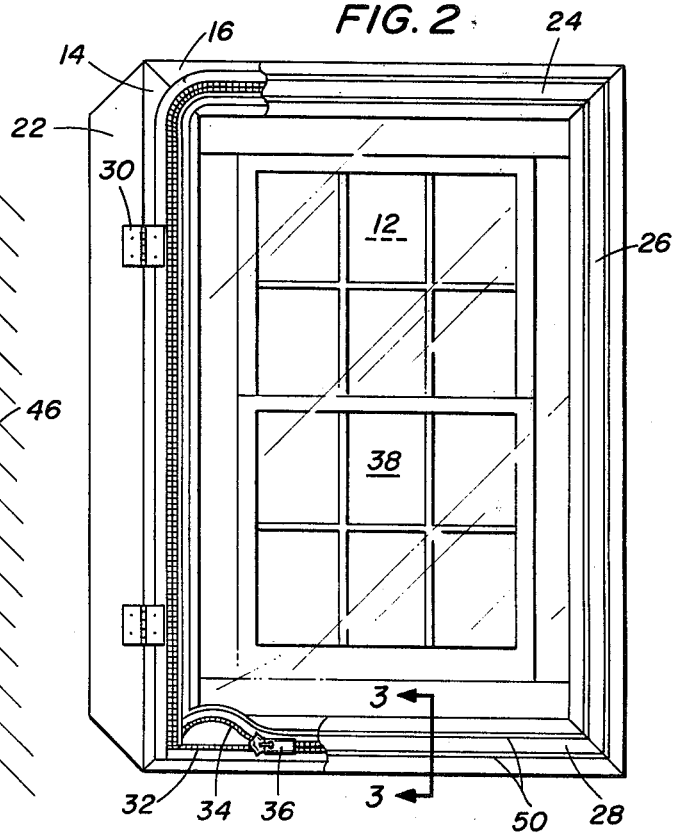
FIG. 2 shows the installation on the inside of a window in a house.

Referring now to the drawings and particularly to FIGS. 1 and 2, an improved insulating or storm window, the zipper-type window for houses, is shown at 10 in FIG. 1 as an exploded view of the components. The assembled zipper-type window 10 is assembled and shown in place on the interior of a house window in FIG. 2.

Figure 3:
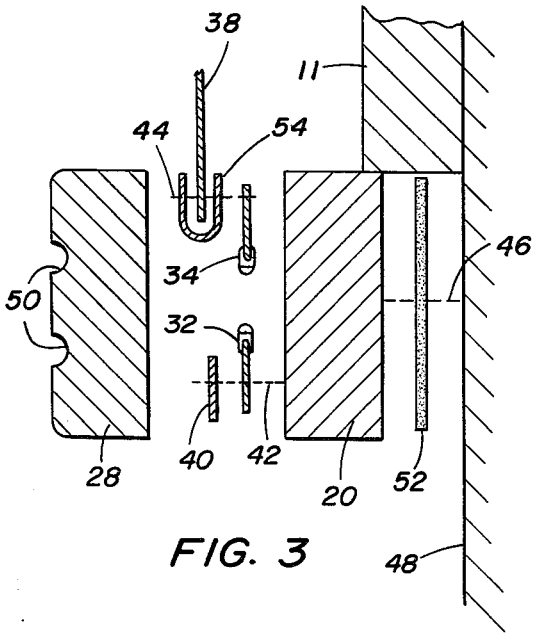
FIG. 3 is an exploded view of a cross section 3—3 of FIG. 2.

Referring now to FIG. 3, the exploded view of section 3—3 of FIG. 2 provides an excellent explanation of how the present invention seals one of the major sources of leakage around a window assembly in a house. It is one of the features that makes this invention an insulating means for a complete window assembly in a house that is not found in the prior art.

In FIG. 3, the frame 11 of a complete window assembly 12 (FIG. 1) is shown fastened to the wall 48 of the house structure. It is at the interface of the frame 11 and the wall 48 where a major source of leakage occurs (the frame 11 of the complete window assembly 12 in FIG. 1, consisting of the side casings 13, the header 15, and the apron 17).

To seal this major source of leakage the present invention seals it by the design which completely surrounds said frame 11. At the interface of the zipper-type window components (hereinafter identified) and the wall 48 on all four sides of the frame 11, that is, at the outside edges of the casings 13, the header 15, and the apron 17, an insulating material 52 (FIG. 3) is sandwiched between the zipper-type window components and the wall 48. The zipper-type window components that surround the four sides of said frame 11 are shown in FIG. 1. They are: stationary side panels 14 and 18 that are installed adjacent to the two window casings 13; stationary top panel 16 tht is installed adjacent to the window header 15; and stationary bottom panel 20 that is installed adjacent to the window apron 17.

In FIG. 3 the stationary bottom panel 20 is shown in relation to said insulating material 52 which is shown between the stationary bottom panel 20 and the wall structure 48. The same relationship exists between stationary panels 14, 16, and 18, insulating material 52, and the wall structure 48.

The stationary panels 14, 16, 18, and 20 are fixed to the wall structure 48 by attaching means 46. The attaching means may be an adhesive, nails, screws, or other method to secure the components together in a tight sandwich manner to seal against all leakage through the exterior edges of the stationary panels.

The stationary panels 14, 16, 18, and 20 are fitted at their joining corners to form a tightly sealed unit. They may be fastened at these fitted corners by an adhesive, nails, screws, cleat, or other means.

It should be noted that other methods of fastening stationary panels 14, 16, 18, and 20 to each other and to said wall structure 48, enclosing said insulating material 52 are within the scope and intent of this invention. It should also be noted that the configuration of the stationary panels 14, 16, 18, and 20 to surround other configurations of window assemblies 12 is within the scope and intent of this invention.

Attached to the stationary panels 14, 16, 18, and 20 are movable panels 22, 24, 26, 28 respectively, attached by hinge means 30. These movable panels 22, 24, 26, and 28 may be shimmed (not shown) under the hinge means 30 to clear the zippered components hereinafter described or said movable panels 22, 24, 26, 28 may be undercut (not shown) to provide a clearance for zippered components, as hereinafter described.

These movable panels 22, 24, 26, and 28 provide a cover means for the zippered components and give the attractive and decorative touch to the installation to make it pleasing to the eye of the beholder. The hinge means 30 permits the movable panels 22, 24, 26, and 28 to be "opened" or moved outwardly on the hinge means so that the zippered panel (hereinafter described) may be installed when full closure is desired or removed when an open-window effect is wanted. As shown in FIG. 3, decorative scoring or fluting 50 of a variety of designs may be added to the movable panels 22, 24, 26, and 28.

The movable panels 24, 26, and 28 are shown in the closed or covering position at the right side of FIG. 2; movable panel 22 is shown in the open or uncovered position by operation of the hinge means 30 at the left side of FIG. 2. The decorative scoring or fluting 50 on the movable panels 24, 26, and 28 is also seen at the right side of FIG. 2.

It should be understood that the manner of hinge means 30 may be butt type, piano type, or any other type of hinge means and such variations are within the scope and intent of this invention. Likewise the variation of the scoring or fluting 50 for the movable panels 22, 24, 26, and 28 is a matter of decorative choice and is within the scope and intent of this invention.

The assembly of the zipper means (frame attached zipper 32, cover panel attached zipper 34, and zipper closer operator 36) are shown in the exposed portion at the left side of FIG. 2. The zipper means components are also shown in the exploded view of FIG. 1, wherein the frame attached zipper 32 is shown on the section which is attached permanently to the frame as hereinafter described, and the cover panel attached zipper 34 is shown on the cover panel that carries the insulating cover 38. The insulating cover may be a clear plastics or any other desired material of any color or degree of opacity.

It should be understood that any such variations of materials, color, clear or opaque, are within the scope and intent of this invention. Likewise, the use of a screen for ventilation instead of the solid-type covering for insulation is also within the scope and intent of this invention.

The zipper closer operator 36 is permanently attached to the cover panel zipper 34. The frame zipper 32 has an entry end for starting the zipper closer operator 36 so that the two components may be attached to each other. This manner of connection and separation is the conventional type as used on clothing jackets and other garments where the zipper components must be separated.

Referring now to FIG. 3, the exploded view shows the manner in which the zipper component 32 is attached to the stationary frame panels (14, 16, 18, and 20) and the zipper component 34 is attached to closure panel 38.

The zipper component 32 is sandwiched between a reinforcement means 40 and the stationary frame panel 20 (or 14, 16, or 18) and fastened permanently in place by attaching means 42 which may be an adhesive, sewing, or other method.

The zipper component 34 is attached to closure panel 38 by attaching it to a reinforcement means 54 that surrounds the edges of closure panel 38. The attachments of zipper component 34, reinforcement means 54, and closure panel 38 together as a unit is by an attaching means 44 which may be an adhesive, sewing, or other method.

It is to be understood that the use of any other method of attaching the zipper components 32 and 34 to the respective adjacent components is within the scope and intent of this invention.

Thus, when the closure panel 38 is installed the permanent and tightly fastened assembly of the components of the zipper-type window for homes provides a barrier against all sources of leakage and provides an effective insulating system. This insulating system also incorporates the attractive decorative aspects, the simplicity of maintenance, the easy method of the initial installation, and the ease with which the closure panel can be installed or removed. None of the prior art incorporates all these features, approaches them in the novel and unique method of this invention, or provides them economically.

Accordingly, modifications and variations to which the invention is susceptible may be practiced without departing from the scope of the appended claims.

What is claimed is:

1. A zipper-type window insulating system for a window to be insulated, comprising:

a wall frame means surrounding said window to be insulated, said wall frame means consisting of a pair of side panels, a top panel, and a bottom panel, each said panel interfacing with adjacent panels to completely surround said window, a fastening means for affixing said wall frame means permanently to the interior wall surface around said window and any existing interior window casings, header and apron of said window;

a sealing means to seal said wall frame means to said interior wall surface, said sealing means being inserted between said wall frame means and said interior wall surface before said fastening means is used to permanently affix said wall frame means to said interior surface, said sealing means interfacing with the entire length of all said panels of said wall frame means, said fastening means holding both said wall frame means and said sealing means together and affixed tightly to said interior wall surface;

a solid and transparent window convering means, said window covering means being disposed over the interior surface of said window to be insulated and spaced therefrom, said window covering means extending beyond the perimeter of said window to be insulated to the approximate center of said panels that make up said wall frame means, a first reinforcement means affixed to and for reinforcing said window covering means along the outer periphery thereof, and a zipper element affixed to the periphery of said window covering means and said first reinforcement means, an adhesive fastening means for permanently affixing said window covering means, said first reinforcement means, and said zipper element to each other;

an attaching means for attaching said window covering means to said wall frame means, said attaching means consisting of a zipper member and a second reinforcement means, said zipper member being sandwiched between said second reinforcement means and said wall frame means to which both said second reinforcement means and said zipper member are permanently affixed by a second adhesive fastening means, said second reinforcement means and said zipper member being disposed around the entire wall frame means at the approximate center of the exposed face thereof and affixed thereto, said window covering means having been disposed over the interior surface of said window is attached to said wall frame means by connecting said zipper element of said window covering means to said zipper member of said attaching means to said wall frame means be engaging and operation of the zipper element around the periphery of said window covering means and the zipper member around the periphery of said wall frame means, said window covering means thereby being removably attached to said wall frame means to insulate said window; and a decorative covering means for said attaching means attaching said window covering means to said wall frame means, said decorative covering means consisting of a decorative panel means having a pair of side decorative panels, a top decorative panel, and a bottom decorative panel, each said decorative panel configured on the ends thereof to removably fit together with each adjacent said decorative panel to form a framelike decorative covering of a size and configuration to removably cover said means attaching said window covering means to said wall frame means, each said decorative panel affixed to the outermost edge of each corresponding said panel of said wall frame means by a hinged means connected to each said decorative panel and to each corresponding said panel of said wall frame means, whereby said decorative covering means is enabled to effect the removable covering and uncovering of said attaching means for attaching said window covering means to said wall frame means.

2. The zipper-type window insulating system recited in claim 1, wherein said fastening means for permanently affixing said wall frame means to said interior wall surface with said sealing means between said wall frame means and said interior wall surface is an adhesive.

3. The zipper-type window insulating system recited in claim 1, wherein said hinged means is a plurality of butt-type hinges.

* * * * *